US005560399A

United States Patent [19]

Kramer

[11] Patent Number: 5,560,399

[45] Date of Patent: Oct. 1, 1996

[54] HEDDLE FRAME WITH LOCKING CLAMP BLOCK CENTER BRACE ASSEMBLY

[75] Inventor: Charles F. Kramer, Greenville, S.C.

[73] Assignee: Steel Heddle Manufacturing Co., Greenville, S.C.

[21] Appl. No.: 509,357

[22] Filed: Jul. 31, 1995

[51] Int. Cl.[6] ..... D03C 9/06

[52] U.S. Cl. ..... 139/91; 403/409.1

[58] Field of Search ..... 139/92, 91; 403/409.1, 403/374, 370, 375

[56] References Cited

U.S. PATENT DOCUMENTS

| | | | |
|---|---|---|---|
| 3,889,721 | 6/1975 | Wagner | 139/91 |
| 4,513,933 | 4/1985 | Lueders | 403/374 X |
| 4,635,685 | 1/1987 | Chabot | 139/91 |
| 4,658,864 | 4/1987 | Goodman, Jr. | 139/91 |
| 4,757,809 | 7/1988 | Koeneman et al. | 403/374 X |
| 4,924,916 | 5/1990 | Faasse et al. | 139/91 |
| 5,082,031 | 1/1992 | Suhr | 139/91 |
| 5,411,061 | 5/1995 | Faase | 403/374 X |

*Primary Examiner*—Andy Falik
*Attorney, Agent, or Firm*—Dority & Manning

[57] ABSTRACT

A heddle frame for supporting a plurality of heddles includes a top rail and a bottom rail extending longitudinally relative to the frame. End members connect the top rail and bottom rail so as to form a generally rectangular frame structure. A center brace extends between the top rail and the bottom rail at a position between the end members. A locking clamp block is attached to the bottom rail. The clamp block defines a first section and a second section which is movable towards the bottom rail relative to the first section. The clamp block defines a threaded hole through the first and second sections. The portion of the threaded hole through the second section becomes misaligned when the second section is tightened or drawn in the direction of the bottom rail while the first section of the clamp block remains stationary. This misalignment of the threaded hole portions securely locks the center brace within the clamp block.

20 Claims, 5 Drawing Sheets

HEDDLE FRAME WITH LOCKING CLAMP BLOCK CENTER BRACE ASSEMBLY

BACKGROUND OF THE INVENTION

The present invention relates to a heddle frame for a loom, and in particular to improved means in the heddle frame for preventing distortion with respect to the top and bottom rails of the heddle frame and for simplifying the adjustment of the frame.

A known heddle frame with an improved center brace assembly is disclosed in U.S. Pat. No. 4,924,916. In this patent, the heddle frame comprises top and bottom rails which are typically made of extruded aluminum. The top and bottom rails are connected to each other at their ends by end struts or members to provide a rigid connection between the rails and to define a generally rectangular harness or heddle frame. The frame includes top and bottom heddle supporting rods upon which heddles are slidably mounted, as commonly understood in the art. A center brace is mounted midway between the ends of the frame, and in some cases a plurality of braces may be employed. These center braces serve to prevent distortion of the frame and to maintain the parallel relationship between the top and bottom rails.

In the '916 patent, the center brace extends through an opening in the top rail and into an opening in the bottom rail. A top sleeve is disposed in the opening in the top rail and extends about the center brace to separate the brace from the opening in the top rail. Means are provided on the upper surface of the top rail to secure and retain the center brace within the opening thereby supporting and maintaining the parallelism of the top and bottom rails. The lower end of the center brace is supported by a nut block which is attached to the upper surface or bottom surface of the bottom rail. The center brace is threadedly engaged within the nut block.

Although the device disclosed in the '916 patent provides a significant improvement in the art, a problem has existed in that a degree of play inherently exists between the threads on the center brace and the threads in the connecting nut block. The heddle frames are in continuous motion and experience continuous vibration. This vibration is transmitted to the center brace, and particularly to the threaded connection between the center brace and the bottom nut block. Thus, due to the inherent play between the threads and the members, a degree of vibration exists between the center brace and the bottom nut block. This continuous vibration results in wear of the threads in the nut block or the center brace, requiring frequent replacement of either the center brace or the attaching nut block.

The present invention eliminates the vibration between the center brace and the nut block and provides a significantly improved center brace assembly.

OBJECTS AND SUMMARY OF THE INVENTION

It is a principal object of the present invention to provide an improved center brace assembly for a heddle frame.

An additional object of the present invention is to provide a center brace assembly which eliminates vibration between the center brace and its attaching points on the heddle frame.

Yet another object of the present invention is to provide a more reliable center brace assembly for a heddle frame which requires less maintenance and replacement of wear components.

And still another object of the present invention is to provide a heddle frame incorporating an improved center brace assembly.

Additional objects and advantages of the invention will be set forth in part in the following description, or may obvious from the description, or may be learned through practice of the invention.

In accordance with the objects of the invention, a heddle frame for supporting a plurality of heddles within the frame is provided. The heddle frame includes a horizontal top rail and a horizontal bottom rail extending longitudinally relative to the frame. End members connect the ends of the top rail and the bottom rail so as to form a generally rectangular frame structure. A heddle bar is supported by each of the top and the bottom rails wherein heddles are supported by the heddle bars within the frame structure. A center brace extends between the top rail and the bottom rail at a position between the end members for maintaining parallelism of the top and bottom rails. The center brace is connected and extends through the top rail.

A locking clamp block is attached to the bottom rail. The clamp block defines a first section and a second section which is movable relative to the first section. The clamp block further defines at least one threaded hole having a portion through the first section aligned with a portion through the second section in the clamp block. The center brace extends into the threaded hole for threaded engagement therewith. The portion of the threaded hole through the second section becomes misaligned with the portion through the first section upon movement of the second section. This misalignment causes the center brace to become locked within the clamp block and eliminates vibration between the clamp block and the center brace. The clamp block can be attached to either the upper surface or the bottom surface of the bottom rail.

In a preferred embodiment, the clamp block comprises a relief channel defined therein which deliminates the first and second sections. The relief channel provides for movement of the second section by compression of the second section against the bottom rail. In this embodiment, the clamp block is attached to the bottom rail by torquing devices, such as torque bolts. At least one of the torquing devices is disposed through the first section and another of the torquing devices is disposed through the second section. Once the center brace is screwed into the threaded hole, the torquing device through the second section is tightened further which causes the second section to cant along a line defined by the relief channel in a plane parallel to a longitudinal plane through the clamp block thereby causing the portions of the threaded hole to misalign and to lock the center brace within the threaded hole. The relief channel is preferably angled with respect to a horizontal plane through the clamp block.

The clamp block comprises a bottom surface which is disposed adjacent to a nut block attached to the bottom rail. The bottom surface of the second section has an offset defined therein which allows for movement of the second section towards the nut block.

In an alternative embodiment, the clamp block may comprise a plurality of first and second sections with respective threaded holes defined therethrough for alternate positioning of the center brace. In other words, the center brace can be shifted between alternate positions defined in the clamp block which is attached to the bottom rail. The bottom rail is essentially hollow and the device further includes nut blocks to which the clamp block is bolted with the torquing devices. The nut blocks may be disposed within the bottom rail, or may be bolted to the top or bottom of the rail.

DETAILED DESCRIPTION OF THE PREFERRED EMBODIMENTS

Reference will now be made in detail to the presently preferred embodiments of the invention, one or more embodiments of which are illustrated in the accompanying drawings. Each example is provided by way of explanation of the invention and is not meant as a limitation of the invention. For example, various modifications and variations can be made in the present invention without departing from the scope or spirit of the invention. It is intended that the present invention cover such modifications and variations. Additionally, the numbering of components is consistent throughout the description and drawings, with the same components having the same number throughout.

Figure 1:
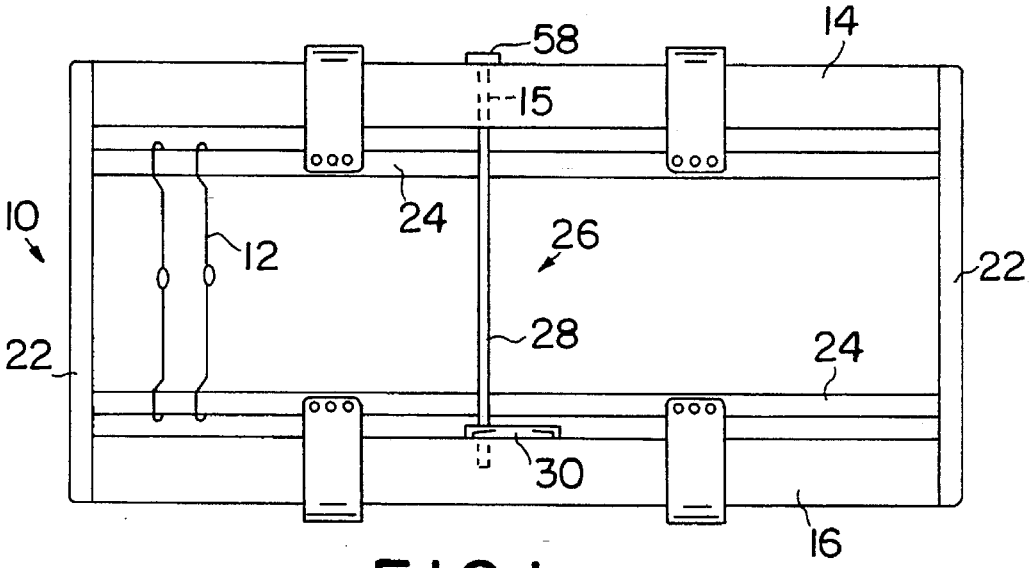
FIG. 1 is a front perspective view of a heddle frame according to the invention.

Referring to FIG. 1 in general, a heddle frame 10 according to the invention is illustrated. Heddle frame 10 comprises a top rail 14 and a bottom rail 16 which extend generally horizontally at a spaced distance from each other. Frame 10 is completed by end members 22 joining top and bottom rails 14 and 16 at each of their ends to form a generally rectangular frame structure. Frame 10 also includes heddle bars 24 on which are suspended a plurality of warp heddles 12, as is commonly understood in the art.

Figure 2:
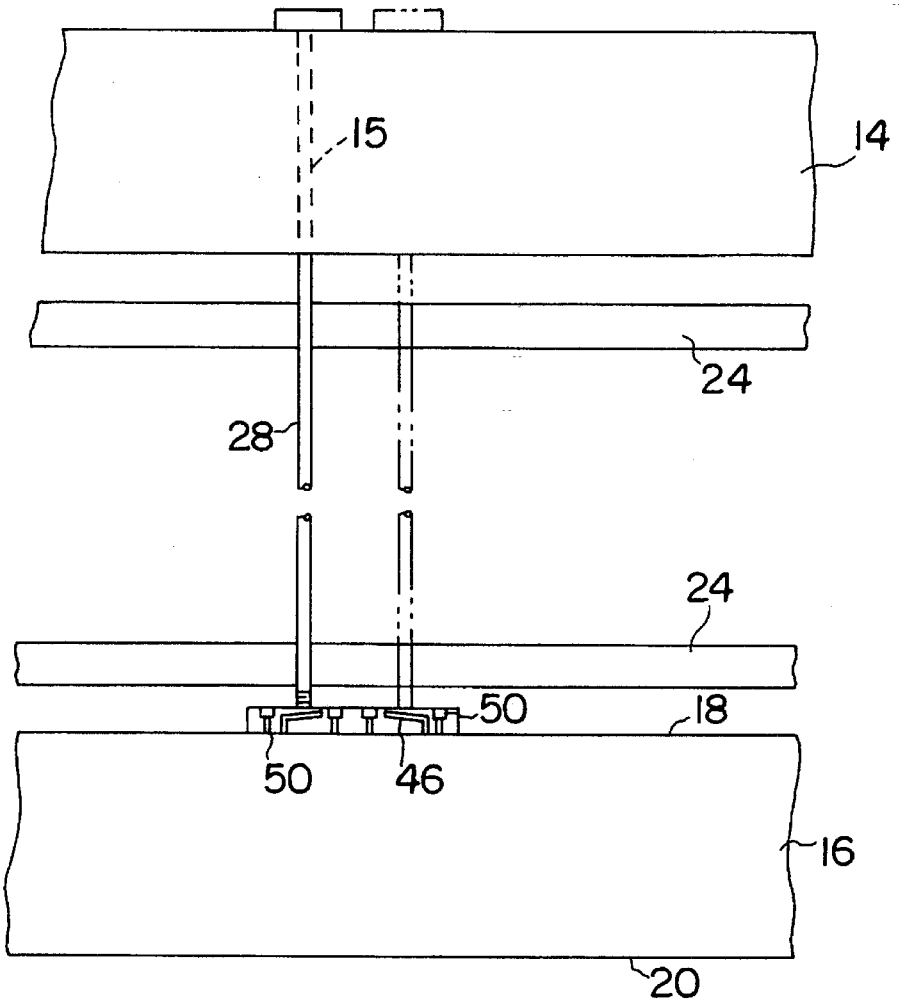
FIG. 2 is a partial enlarged view of the center brace assembly of the present invention.
Figure 3:
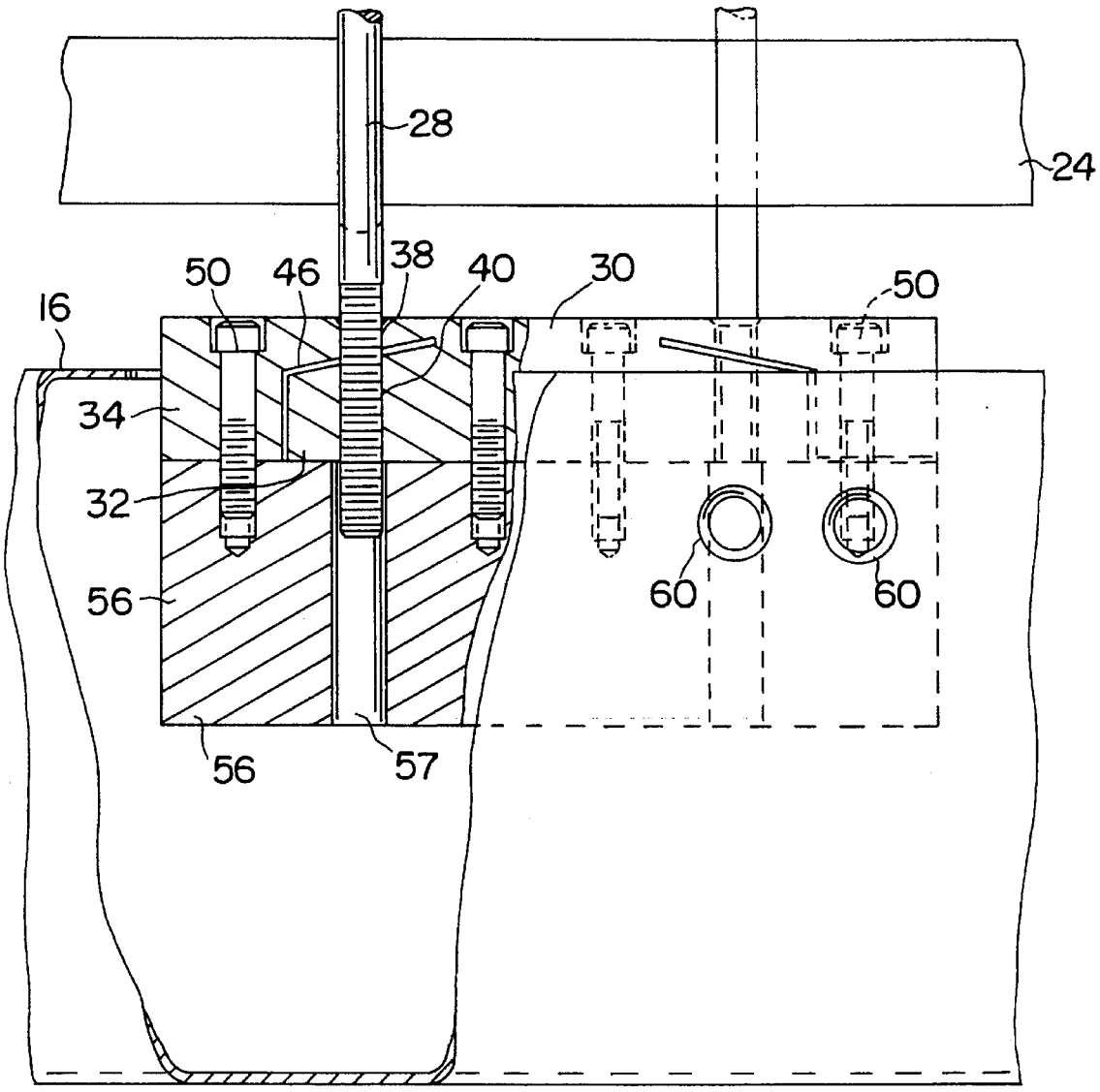
FIG. 3 is a partial cut-away view of the locking clamp block assembly within the bottom rail.

Referring generally to FIG. 2, heddle frame 10 includes a center brace assembly 26. Center brace assembly 26 includes a center brace or bolt 28 connected to top rail 14 and bottom rail 16 to provide additional support for maintaining the top and bottom rails parallel to each other. Center brace 28 extends through a top opening 15 in top rail 14. Center brace 28 extends into a locking clamp block 30 which is configured with bottom rail 16, as will be discussed in more detail below.

The remaining figures particularly illustrate the unique features of the locking clamp block 30 of the center brace assembly 26. Referring particularly to FIGS. 3 through 6, clamp block 30 is non-movably secured or attached relative to bottom rail 16. In a preferred embodiment, bottom rail 16 is essentially hollow and formed of extruded aluminum or steel tubing. A nut block 56 is disposed within the hollow space of bottom rail 16 and is held in position through any manner of means, such as spot welds 60 as particularly shown in FIG. 3. Nut block 56 could also be bolted within bottom rail 16. Alternatively, nut block 56 could be bolted or otherwise attached to the top surface 18 of bottom rail 16 or a bottom surface 20 of the rail. In essence, nut block 56 provides a means for attaching the locking clamp block 30 to bottom rail 16. For example, in the embodiment illustrated, clamping block 30 is attached to nut block 56 through means of torque bolts 50.

Figure 5:
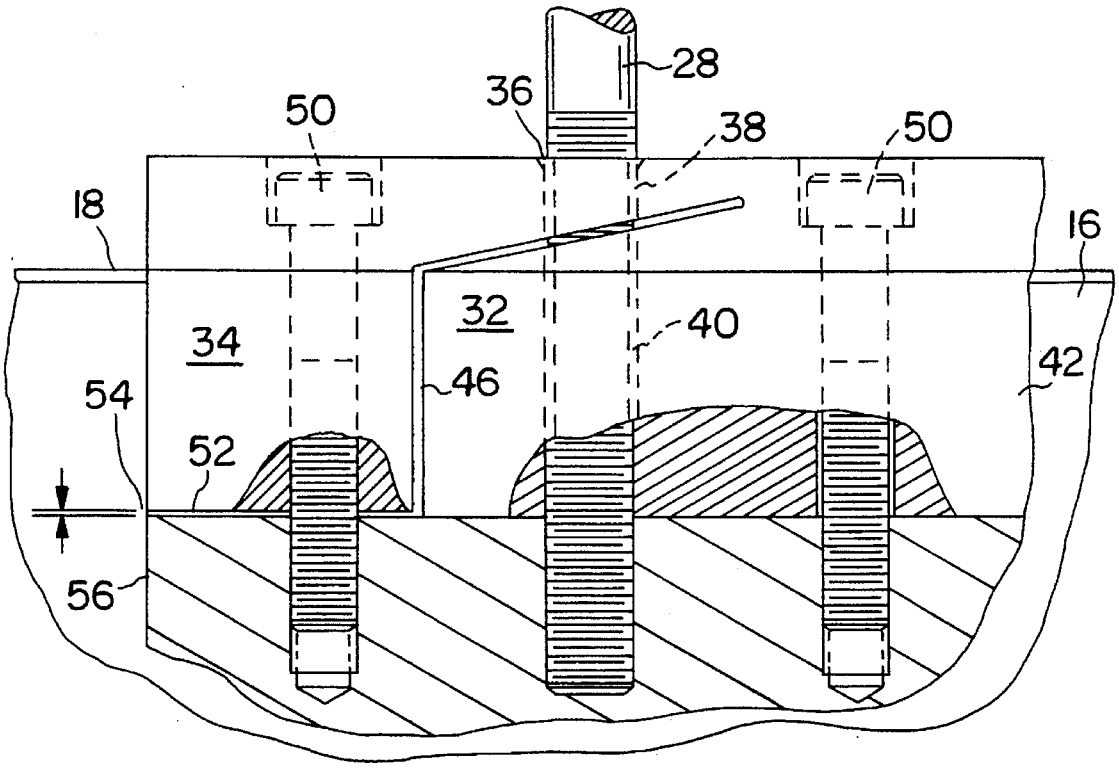
FIG. 5 is an alternative cut-away view of the clamp block assembly particularly illustrating the relief channel and the first and second sections of the clamp block.
Figure 6:
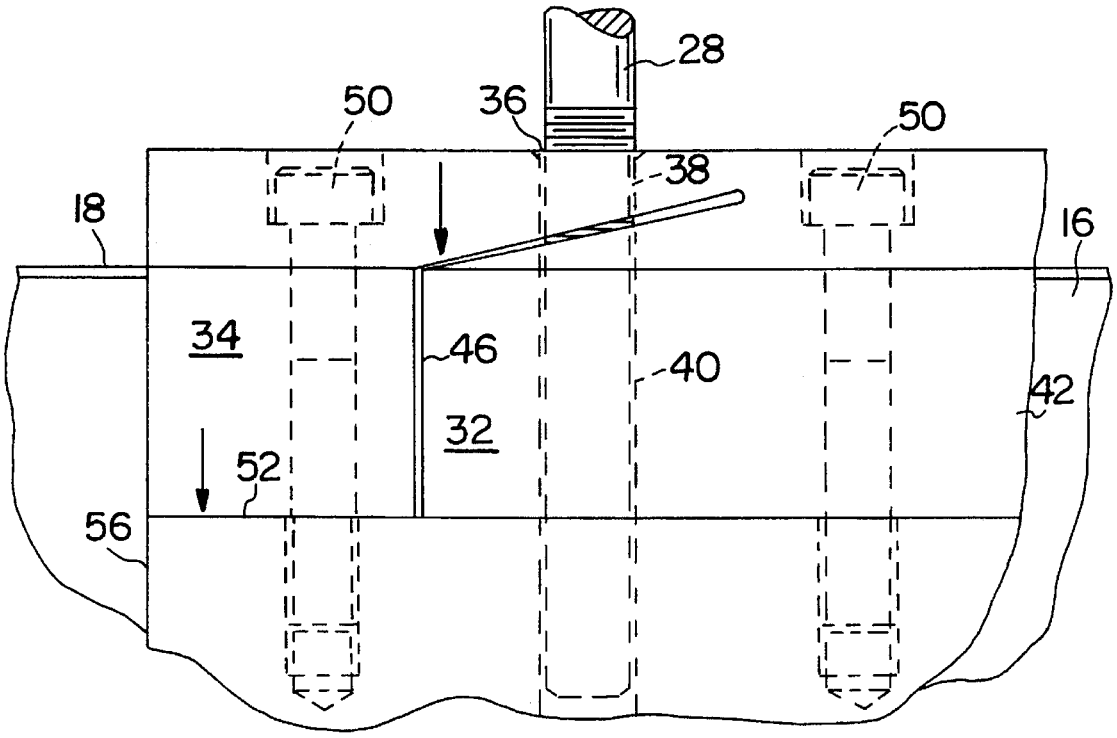
FIG. 6 is a view of the device illustrated in FIG. 5 particularly illustrating the misalignment of the threaded hole portions.

Clamp block 30 includes a first section 32 and a second section 34, as particularly illustrated in FIGS. 5 and 6. Sections 32 and 34 are delimited by a relief channel or groove 46 defined in clamp block 30. Groove 46 is defined completely through clamp block 30. Clamp block 30 also includes a threaded hole 36 defined therein. Threaded hole 36 is defined through both of the sections 32 and 34. In other words, hole 36 includes a first portion 38 through second section 34 of the clamp block and another portion 40 defined through the first section 32 of the clamp block. As particularly illustrated in FIG. 5, the portions of the threaded hole 38, 40 are aligned for threaded receipt of center brace 28.

Second section 34 of clamping block 30 is movable relative to the first section 32 in a direction towards the bottom rail or nut block 56. In this regard, clamp block 30 includes a bottom surface 52 disposed adjacent to nut block 56. The bottom surface 52 of second section 34 has a relief 54 defined therein which allows for movement of the section 34 towards nut block 56. Relief channel 46 in cooperation with relief 54 defines the degree of movement of section 34 towards nut block 56.

FIG. 5 illustrates the device wherein center brace 28 is initially threadedly engaged within clamp block 30. In this initial engagement phase, torque bolts 50 hold clamp block 30 to nut block 56. The right hand nut bolt 50 may be tightened to a maximum degree. However, the left hand torque bolt 50 is relatively loose such that the bottom surface 52 of second section 34 does not contact nut block 56 due to relief 54.

Referring to FIG. 6, once center brace 28 has been threadedly received within threaded hole 36, left hand torque bolt 50 is tightened further which causes second section 34 of clamp block 30 to be drawn towards nut bolt 56. This motion causes second section 34 to cant along a line defined by relief channel 46, as particularly illustrated in FIG. 6, causing the top portion 38 of threaded hole 36 to essentially become misaligned relative to the bottom portion 40 of the threaded hole. This intentional misalignment of the threaded hole portions securely locks the threaded portion of brace 28 within clamp block 30. Center brace 28 cannot be rotated or otherwise moved relative to clamp block 30 in the condition illustrated in FIG. 6. Thus, any vibrational movement between the two components is eliminated.

Figure 7:
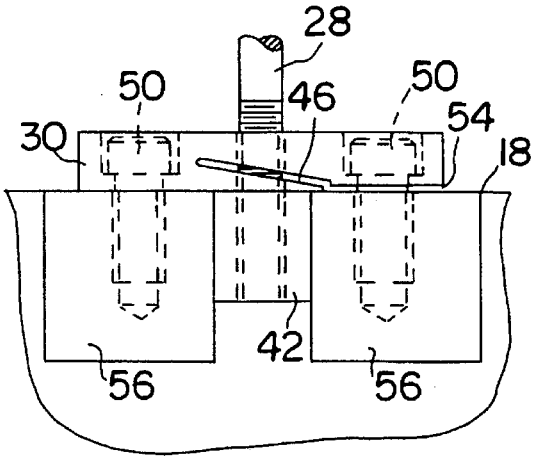
FIG. 7 is a partial cut-away view of a clamp block assembly particularly illustrating the relief channel defined therein.

It should be understood that any manner of relief channel 46 may be defined in clamp block 30 to achieve the relative motion between sections 34 and 32 which causes misalignment of the threaded hole portions 38, 40. For example, FIG. 7 illustrates an embodiment wherein relief 46 comprises an essentially angled relief line extending directly from the relief portion 54. Relief 46 is angled relative to a horizontal plane through the clamp block. Alternatively, relief channel 46 may comprise a vertical portion in communication with an angled portion, as particularly illustrated in FIG. 8. The only requirement is that relief channel 46 provide for a degree of movement of the respective sections of the clamp block once second section 34 is drawn or tightened further towards nut block 56. For example, relief 46 could define a circular or semi-circular cross-section which, in essence, defines a pivot point for movement of section 34. It is within the scope and spirit of the invention to include any manner of relief 46.

Figure 8:
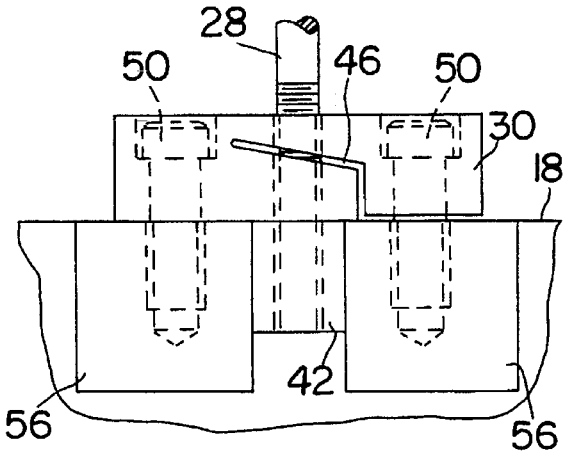
FIG. 8 is another partial cut-away view of the clamp block illustrating an alternative design of the relief channel.
Figure 9:
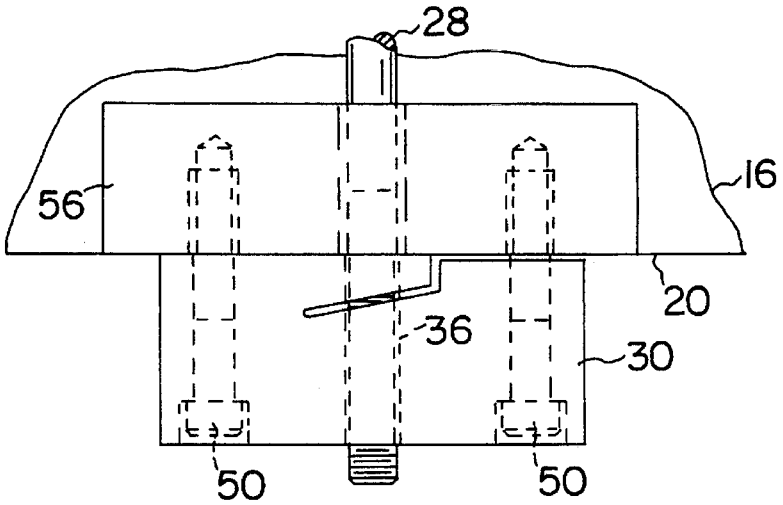
FIG. 9 is an alternative view of a clamp block assembly according to the invention configured adjacent to a bottom surface of the bottom rail.

It should further be understood that clamp block 30 can be attached to upper surface 18 of bottom rail 16, as depicted in FIGS. 1 through 8, or attached to bottom surface 20 of bottom rail 16, as depicted in FIG. 9. In the embodiment depicted in FIG. 9, center brace 28 would extend completely through bottom rail 16 and nut block 56 to be threadedly engaged within threaded hole 36 of clamp block 30.

Figure 4:
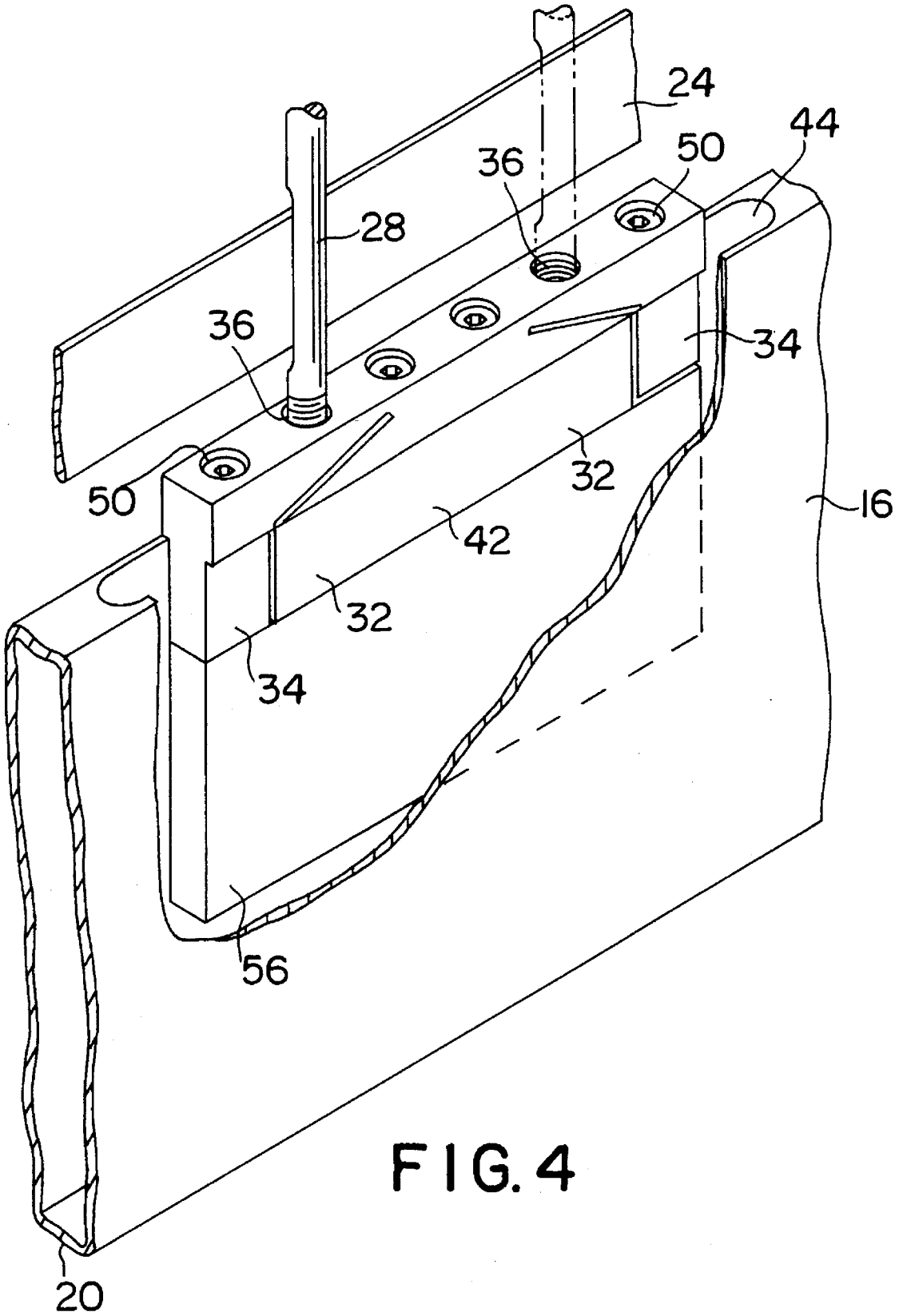
FIG. 4 is an alternative cut-away view of the clamp block assembly.

In the embodiments illustrated, bottom rail 16 is hollow and nut block 56 is located within the bottom rail. Nut block 56 may be essentially flush with the top surface 18 of the rail 16, as depicted in FIG. 5, or may be recessed within a hole 44, as depicted in FIG. 4. In the embodiment of FIG. 4, clamp block 30 includes an extension section 42 which fits within hole 44 for engagement with nut block 56. Any manner of configuration of nut block 56 may be utilized. For example, FIGS. 7 and 8 illustrate an embodiment wherein separate nut blocks 56 are utilized. In this embodiment, bolts 50 secure each section of clamp block 30 to the independent nut blocks 56. Clamp block 30 in this embodiment includes an extension member 42 which slides between the nut block 56. In an alternative embodiment not particularly illustrated in the figures, nut block 56 could be attached to the outside of bottom rail 16 either to the bottom or top surfaces thereof. Any and all such arrangements are within the scope and spirit of the invention.

The top section of the center brace assembly 26 is connected to the top rail 14 by any conventional means. For example, referring particularly to FIGS. 1 and 2, center brace 28 may include a top end cap 58 attached thereto. End cap 58 is used to screw brace 28 into clamp block 30. Once the bolt 28 is properly positioned, end cap 58 can be bolted into nut blocks (not shown) disposed within top rail 14. Alternatively, nut blocks may be disposed on the top surface of upper rail 14. It is also possible that end cap 15 is bolted directly into upper rail 14. Any manner of attaching means may be utilized to attach the upper portion of the center brace assembly to upper rail 14.

It will be apparent to those skilled in the art that various modifications and variations can be made in the present invention without departing from the scope or spirit of the invention. For example, features illustrated or described as part of one embodiment, can be included in another embodiment to yield a still further embodiment. It is intended that the present invention cover such variations and modifications as come within the scope of the appended claims and their equivalents.

What is claimed is:

1. A heddle frame for supporting a plurality of heddles, said frame comprising:

a top rail and a bottom rail extending longitudinally relative said frame;

end members connecting each end of said top rail and said bottom rail so as to form a generally rectangular frame structure therewith;

a heddle bar supported on each of said top rail and said bottom rail wherein heddles are supported by said heddle bars within said frame structure;

a center brace extending between said top rail and said bottom rail at a position between said end members for maintaining parallelism of said top and bottom rails, said center brace connected to and extending through said top rail; and a locking clamp block attached to said bottom rail, said clamp block defining a first section and a second section which is movable towards said bottom rail relative to said first section, said clamp block further defining at least one threaded hole having a portion through said first section aligned with a portion through said second section for threaded engagement with said center brace, said clamp block including means for moving said second section relative to said first section whereby said portion through said second section becomes misaligned with said portion through said first section upon movement of said second section thereby locking said center brace within said clamp block.

2. The heddle frame as in claim 1, wherein said clamp block is attached to an upper surface of said bottom rail.

3. The heddle frame as in claim 2, wherein said clamp block further comprises an extension section which is slidably received within a hole defined in said upper surface of said bottom rail.

4. The heddle frame as in claim 1, wherein said clamp block is attached to a bottom surface of said bottom rail, said clamp block extending through said bottom rail into said clamp block.

5. The heddle frame as in claim 4, wherein said clamp block further comprises an extension section which is slidably received within a hole defined in said bottom surface of said bottom rail.

6. The heddle frame as in claim 1, wherein said clamp block comprises a relief channel defined therein, said relief channel delimiting said first and second sections, said relief channel providing for movement of said second section by compression of said second section against said bottom rail.

7. The heddle frame as in claim 6, wherein said clamp block is attached to said bottom rail by torquing devices, at least one said torquing device disposed through said first section and one said torquing device disposed through said second section, wherein once said center brace is threadedly engaged within said threaded hole, said torquing device through said second section is tightened further causing said second section to cant along a line defined by said relief channel thereby causing said portions of said threaded hole to misalign and lock said center brace within said threaded hole.

8. The heddle frame as in claim 7, wherein said torquing devices comprise torque bolts.

9. The heddle frame as in claim 7, wherein said relief channel is angled with respect to a horizontal plane through said clamp block.

10. The heddle frame as in claim 7, wherein said clamp block comprises a bottom surface adjacent said bottom rail, said bottom surface of said second section having an offset defined therein allowing for movement of said second section towards said bottom rail.

11. The heddle frame as in claim 1, wherein said clamp block comprises a plurality of said first and second sections with threaded holes defined therethrough for alternate positioning of said center brace.

12. The heddle frame as in claim 1, wherein said top and bottom rails are essentially hollow and comprise nut blocks disposed therein, said center brace comprising a cap at the top thereof attached to said top rail nut block, said clamp block attached to said bottom rail nut block.

13. The heddle frame as in claim 12, wherein said nut blocks are disposed within said top and bottom rails respectively.

14. A center brace assembly for use with heddle frames to maintain parallelism between the top and bottom rails of the heddle frames, said assembly comprising:

a center brace having a length and configured to be connectable between the ends of a top rail and a bottom rail of a heddle frame for maintaining parallelism of said top and bottom rails; and a locking clamp block adapted to be attachable to said bottom rail, said clamp block defining a first section and a second section which is movable relative to said first section, said clamp block further defining at least one threaded hole having a portion through said first section aligned with a portion through said second section for threaded engagement with said center brace, said clamp block including means for moving said second section relative to said first section whereby said portion through said second section becomes misaligned with said portion through said first section upon movement of said second section thereby locking said center brace within said clamp block.

15. The center brace assembly as in claim 14, wherein said clamp block further comprises an extension section which is slidably adapted to be receivable within a hole defined in an upper surface of said bottom rail.

16. The center brace assembly as in claim 14, wherein said clamp block comprises a relief channel defined therein, said relief channel defining said first and second sections, said relief channel providing for movement of said second section by compression of said second section against said bottom rail.

17. The center brace assembly as in claim 16, wherein said clamp block further comprises torquing devices for attaching said clamp block to said bottom rail, at least one said torquing device disposed through said first section and one said torquing device disposed through said second section, wherein once said center brace is threadedly engaged within said threaded hole, said torquing device through said second section is tightened further causing said second section to cant along a line defined by said relief channel thereby causing said portions of said threaded hole to misalign and lock said center brace within said threaded hole.

18. The center brace assembly as in claim 17, wherein said torquing devices comprise torque bolts.

19. The center brace assembly as in claim 17, wherein said relief channel is angled with respect to a horizontal plane through said clamp block.

20. The center brace assembly as in claim 17, wherein said clamp block comprises a bottom surface, said bottom surface of said second section having an offset defined therein allowing for movement of said second section towards said bottom rail once said clamp block is attached to said bottom rail.

* * * * *